US006535077B1

(12) United States Patent
Hiroshima et al.

(10) Patent No.: US 6,535,077 B1
(45) Date of Patent: Mar. 18, 2003

(54) DIELECTRIC FILTER, DIELECTRIC DUPLEXER, AND COMMUNICATION APPARATUS

(75) Inventors: Motoharu Hiroshima, Ishikawa-ken (JP); Shohachi Nishijima, Komatsu (JP); Hideyuki Kato, Ishikawa-ken (JP)

(73) Assignee: Murata Manufacturing Co. Ltd (JP)

( * ) Notice: Subject to any disclaimer, the term of this patent is extended or adjusted under 35 U.S.C. 154(b) by 0 days.

(21) Appl. No.: 09/543,506

(22) Filed: Apr. 6, 2000

(30) Foreign Application Priority Data

Apr. 6, 1999 (JP) ..... 11-098476
Feb. 15, 2000 (JP) ..... 2000-036302

(51) Int. Cl.[7] ..... H01P 5/10; H01P 1/203; H01P 1/20

(52) U.S. Cl. ..... 333/26; 333/134; 333/204; 333/206

(58) Field of Search ..... 333/26, 204, 206, 333/202, 134

(56) References Cited

U.S. PATENT DOCUMENTS 5,489,882 A 2/1996 Ueno ..... 333/206
5,497,137 A * 3/1996 Fujiki ..... 336/200
5,557,246 A * 9/1996 Ishihara et al. ..... 333/206
5,697,088 A * 12/1997 Gu ..... 455/307
6,133,806 A * 10/2000 Sheen ..... 333/26

FOREIGN PATENT DOCUMENTS

EP 0869574 10/1988

OTHER PUBLICATIONS

Gokdemir T, et al. "Design and Performance of GAAS MMIC CPW Baluns Using Overlaid and Spiral Couplers" 1997 IEEE MTT–S International Microwave Symposium Digest vol. 2, Jun. 8, 1997.

Laughlin G J, "A New Impedance–Matched Wide–band balun and Magic Tee" IEEE Transactions on Microwave Theory and Techniques, IEEE Inc. New York, US, vol. MTT–24, No. 3, Mar. 1, 1976, pp. 135–141.

* cited by examiner

*Primary Examiner*—Robert Pascal
*Assistant Examiner*—Stephen E. Jones
(74) *Attorney, Agent, or Firm*—Dickstein, Shapiro, Morin & Oshinsky, LLP

(57) ABSTRACT

There is disclosed a dielectric filter comprising: a λ/2 resonator for generating resonance of ½-wavelength at a predetermined frequency, having both ends open-circuited or short-circuited; and a pair of λ/4 resonators respectively for generating resonance of ¼-wavelength at a frequency substantially equal to the predetermined frequency, each having one end open-circuited and the other end short-circuited; wherein the pair of λ/4 resonators are disposed in proximity to each of both ends from the vicinity of the center of the λ/2 resonator; a terminal coupling to the λ/2 resonator is provided as an unbalanced terminal; and terminals coupling to the pair of λ/4 resonators is used as a balanced terminal.

In the above filter, the balanced-type input/output of signals can be performed without using a balun.

14 Claims, 7 Drawing Sheets

DIELECTRIC FILTER, DIELECTRIC DUPLEXER, AND COMMUNICATION APPARATUS

BACKGROUND OF THE INVENTION

1. Field of the Invention

The present invention relates to dielectric filters, dielectric duplexers, and communication apparatuss incorporating the same, which are used in high-frequency bands.

2. Description of the Related Art

FIGS. 10A to 10E show the structure of a dielectric filter using a dielectric block, which is mainly used in a microwave band. FIG. 10B is a front view of the dielectric filter stood up, FIG. 10A is a top view thereof, FIG. 10C is a bottom view thereof, FIG. 10D is a left-side view thereof, and FIG. 10E is a right-side view thereof. In FIGS. 10A to 10E, a reference numeral 1 denotes a dielectric block. Inside the dielectric block 1, resonance line holes indicated by reference numerals 2*a*, 2*b*, and 2*c* are formed. On the inner surfaces of the resonance line holes, inner conductors are disposed to form resonance lines 5*a*, 5*b*, and 5*c*. A ground electrode 3 is formed on an external surface of the dielectric block 1, and external terminals 6 and 7 are provided by insulating from the ground electrode 3. The external terminal 6 capacitively couples with the resonance line 5*a*, and the external terminal 7 capacitively couples with the resonance line 5*c*. In this way, a dielectric filter having band pass characteristics of a three-stage resonator is constituted.

In such a dielectric filter shown in FIGS. 10A to 10E, the external terminals 6 and 7 performs an unbalanced-type input/output of signals while using each ground electrode as a reference potential. In order to send a signal to a balanced-input-type amplifying circuit, for example, a balun (an unbalance-balance conversion unit) must be used to convert an unbalanced-type signal into a balanced-type signal. As a result, the area occupied by a filter-circuit part on a circuit board is increased, which leads to a hindrance to miniaturization.

SUMMARY OF THE INVENTION

To overcome the above described problems, preferred embodiments of the present invention provide a dielectric filter, a dielectric duplexer, and a communication apparatus incorporating the same, in which the balanced-type input/output of signals can be performed without using a balun mentioned above.

One preferred embodiment of the present invention provides a dielectric filter comprising: a λ/2 resonator for generating resonance of ½-wavelength at a predetermined frequency, having both ends open-circuited or short-circuited; and a pair of λ/4 resonators respectively for generating resonance of ¼-wavelength at a frequency substantially equal to the predetermined frequency, each having one end open-circuited and the other end short-circuited; wherein the pair of λ/4resonators are disposed in proximity to each of both ends from the vicinity of the center of the λ/2 resonator; a terminal coupling to the λ/2 resonator is provided as an unbalanced terminal; and terminals coupling to the pair of λ/4 resonators is used as a balanced terminal.

According to the above structure and arrangement, an unbalanced terminal and balanced terminals can be used to input and output signals, and pass and attenuation in a predetermined frequency band can also be performed by using these terminals.

In the above described dielectric filter, the λ/2 resonator may be bent at substantially the center of the λ/2 resonator.

According to the above described arrangement, a λ/2 resonator and λ/4resonators coupling thereto can be disposed at both sides, by which a compact arrangement can be obtained in a restricted space.

Another preferred embodiment of the present invention provides a dielectric filter comprising: a first λ/2 resonator for generating resonance of ½-wavelength at a predetermined frequency, having both ends open-circuited or short-circuited; and a second λ/2 resonator for generating resonance of ½-wavelength at a frequency substantially equal to the predetermined frequency, having both ends open-circuited; wherein the second λ/2 resonator is disposed in proximity to the first λ/2 resonator; a terminal coupling to the first λ/2 resonator is provided as an unbalanced terminal; and two terminals coupling to the second λ/2 resonator are provided as balanced terminals.

According to the above structure and arrangement, an unbalanced terminal and balanced terminals can be used to input and output signals, and pass and attenuation in a predetermined frequency band can also be performed by using these terminals as well.

In the above described dielectric filter, the λ/2 resonator and the λ/4 resonator may be each either formed by a micro stripline or a stripline.

According to the above structure and arrangement, without disposing a balun, in addition to a circuit for performing the balanced input/output of signals and a circuit for performing the unbalanced input/output of signals, a circuit having a filter can be easily formed on a dielectric substrate.

In the above described dielectric filter, the λ/2 resonator and the λ/4 resonator may be formed by a dielectric coaxial resonator comprising a dielectric block on which a conductor film is disposed.

According to the above structure and arrangement, although the dielectric filter has a coaxial resonator, when the dielectric filter is only mounted on a printed circuit board or the like, in addition to a circuit for performing the balanced input/output of signals and a circuit for performing the unbalanced input/output of signals, a circuit having a filter can be easily formed without the need for a balun.

Yet another preferred embodiment of the present invention provides a dielectric duplexer comprising the dielectric filter described above.

Yet another preferred embodiment of the present invention provides a communication apparatus comprising the dielectric filter or the dielectric duplexer described above.

The above described communication apparatus can be formed in a compact size with lightweight.

Other features and advantages of the present invention will become apparent from the following description of the invention which refers to the accompanying drawings.

DESCRIPTION OF PREFERRED EMBODIMENT

The structure of a dielectric filter in accordance with a first embodiment of the present invention will be illustrated with reference to FIG. 1.

Figure 1A:
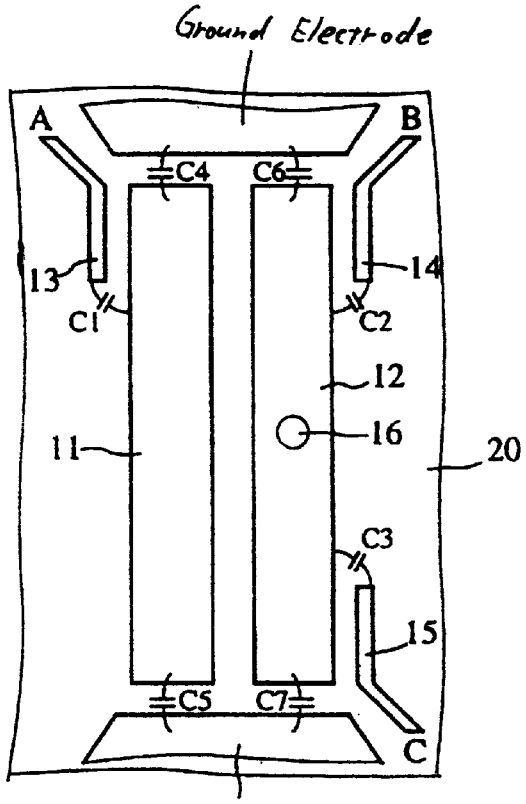
FIG. 1A and FIG. 1B respectively show a plan view of a dielectric filter and an equivalent circuit diagram thereof according to a first embodiment of the present invention.

FIG. 1A is a plan view of the dielectric filter. In this case, reference numerals 11 and 12 denote stripline electrodes, which are disposed in proximity to each other on the upper surface of a dielectric substrate 20. A ground electrode is formed substantially on the entire lower surface of the dielectric substrate 20. The dielectric substrate 20, the stripline electrodes 11 and 12, and the ground electrode form micro stripline resonators. Reference numeral 16 denotes a through-hole to electrically connect the center of the stripline electrode 12 to the ground electrode on the lower surface of the substrate 20. Reference numerals 13, 14, and 15 denote stripline electrodes as terminals. A capacitance C1 is formed between an end of the stripline electrode 13 and a part near an edge of the stripline electrode 11. In addition, a capacitance C2 is generated between the stripline electrode 14 and a part near an edge of the stripline electrode 12 and a capacitance C3 is generated between the stripline electrode 15 and a part near the other edge of the stripline electrode 12. Furthermore, stray capacitances C4, C5, C6, and C7 are generated between each open-circuited end of the stripline electrodes 11 and 12 and the ground electrode, respectively.

The stripline electrode 11 serves as a λ/2 resonator having both ends open-circuited, and the stripline electrode 12 serves as two λ/4 resonators, each having an end short-circuited and the other end open-circuited. The λ/2 resonator and the two λ/4 resonators make comb-line coupling. Since the line lengths of the stripline electrodes 11 and 12 are substantially equal, the resonant frequencies of the above λ/4 resonators are substantially equal to that of the λ/2 resonator.

Figure 1B:
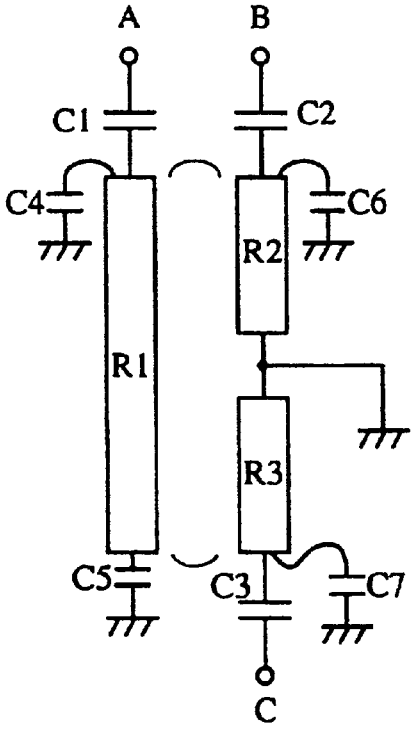

FIG. 1B is an equivalent circuit diagram of a dielectric filter shown in FIG. 1A. In this case, reference numeral R1 denotes the above λ/2 resonator, and reference numerals R2 and R3 denote the above λ/4 resonators. When a signal is inputted from a terminal A, the potentials at both ends of the λ/2 resonator couple to the signal and are reversed, and with maintaining the potential differences, the λ/2 resonator couples with each of the λ/4 resonators. As a result, outputs with the phase difference of 180°, which have filter characteristics, are obtained from output terminals B and C. Accordingly, the terminal A can be used an unbalanced input terminal, whereas the terminals B and C can be used as balanced output terminals. There are provided band-pass-characteristic-type filter characteristics produced by the λ/2 resonator and the λ/4 resonators between the input and the output.

In contrast, when a balanced-type input of signals to the terminals B and C is performed, an unbalanced-type output of signals can be obtained from the terminal A.

Furthermore, as a way for coupling the above λ/2 resonator with the two λ/4 resonators, other than the comb-line coupling, these resonators may be coupled by adding a lumped-constant element such as a capacitor.

In the example shown in FIGS. 1A and 1B, the comb-line coupling (inductive coupling) is generated by forming the above stray capacitances. However, for example, a capacitive coupling may be made by broadening the widths of the open-circuited ends of the stripline electrodes 11 and 12.

Furthermore, in the example shown in FIGS. 1A and 1B, the center of the stripline electrode is electrically connected to the ground electrode on the lower surface of the dielectric substrate by the through-hole. However, a ground electrode disposed on the same surface as that where a stripline electrode is disposed on the dielectric substrate may be connected to the center of the stripline electrode.

Figure 2:
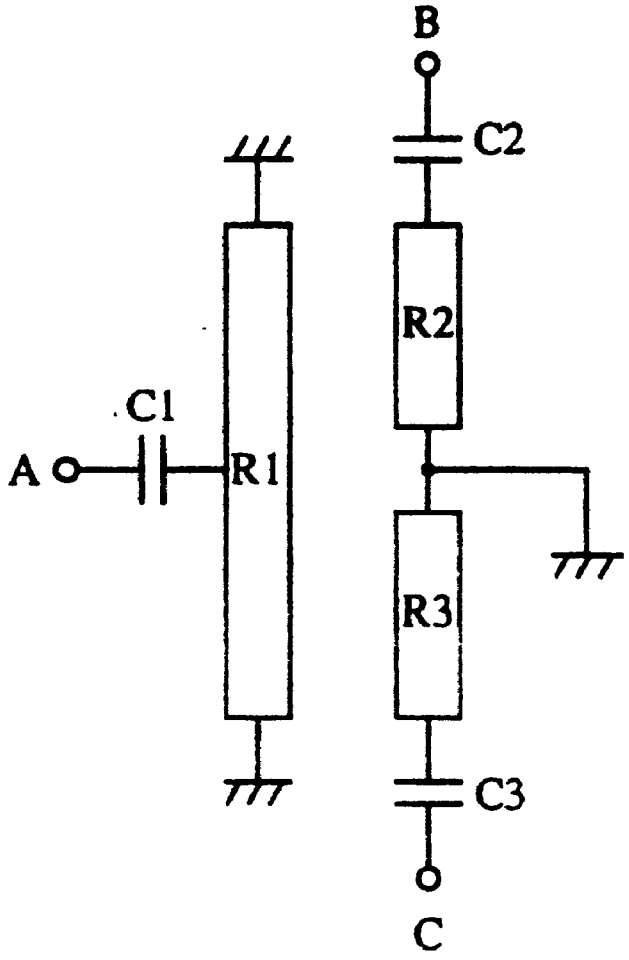
FIG. 2 shows an equivalent circuit diagram of a dielectric filter according to a second embodiment of the present invention.

FIG. 2 is an equivalent circuit diagram of a dielectric filter according to a second embodiment of the present invention. In this example, a λ/2 resonator R1, and λ/4 resonators R2 and R3 are disposed in proximity to each other, the ends of the λ/2 resonator R1 are short-circuited. Between the center of the λ/2 resonator and a terminal A, a capacitance C1 is generated to make external coupling. The λ/4 resonators R2 and R3, and the relationships between the resonators R2 and R3 and the external coupling are the same as those shown in FIG. 1.

In FIG. 2, the center of the λ/2 resonator R1 is equivalently an open-circuited end, and the λ/2 resonator R1 and the two λ/4 resonators R2 and R3 interdigitally couple. With this structure, a dielectric filter having a terminal A as an unbalanced terminal and terminals B and C as balanced terminals can be obtained.

Figure 3:
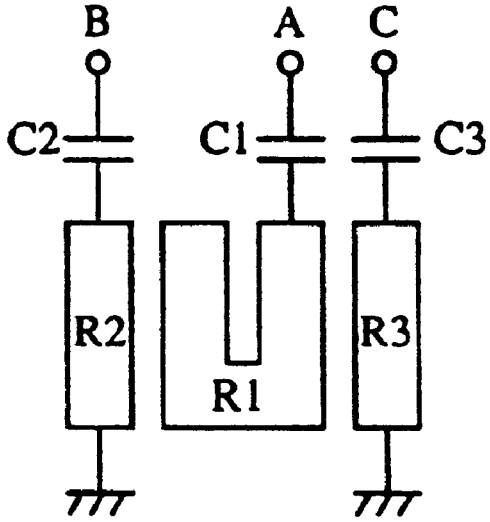
FIG. 3 shows an equivalent circuit diagram of a dielectric filter according to a third embodiment of the present invention.

FIG. 3 is an equivalent circuit diagram of a dielectric filter according to a third embodiment of the present invention. This dielectric filter is different from that shown in FIG. 1 in such a way that the vicinity of the center of a λ/2 resonator R1 is bent in a C-letter form or U-letter form, and two λ/4 resonators R2 and R3 are disposed in proximity to the λ/2 resonator R1. Since the resonator R1 serves as a λ/2 resonator over the entire length of the stripline electrode, this is the same as the case of the first embodiment shown in FIG. 1. However, in the structure shown in FIG. 3, since the length of the stripline electrode can be adjusted to the resonator length of the λ/4 resonator, areas occupied by the resonators on the dielectric substrate can be easily decreased.

Figure 4:
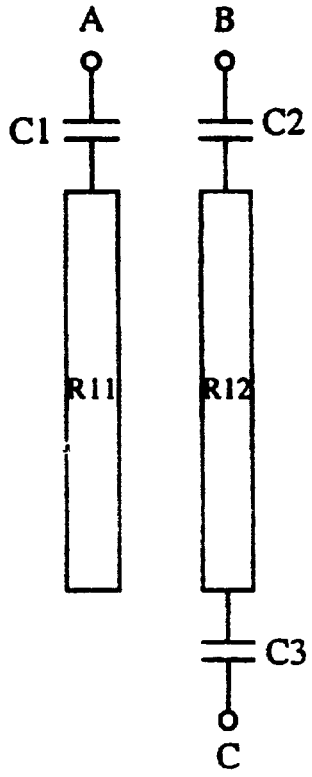
FIG. 4 shows an equivalent circuit diagram of a dielectric filter according to a fourth embodiment of the present invention.

FIG. 4 is an equivalent circuit diagram of a dielectric filter according to a fourth embodiment of the present invention. In this figure, reference numerals R11 and R12 denote micro-stripline resonators, which serve as λ/2 resonators. The two resonators R11 and R12 are electromagnetically coupled. As the way for coupling the resonators, as described above, capacitive coupling may be made by widening the open-circuited ends of the micro-stripline resonators. Alternatively, comb-line coupling may be made by forming a stray capacitance between the open-circuited ends thereof and a ground electrode. In addition, a lumped-constant element such as a capacitor may be added. A capacitance C1 is generated between one end of the resonator R11 and an external terminal A. A capacitance C2 is generated between one end of the resonator R12 and an external terminal B, and a capacitance C3 is generated between the other end of the resonator R12 and an external terminal C. At the ends of the λ/2 resonators R11 and R12, each phase is reversed to make coupling, and while maintaining the phase difference, the ends of the resonators are connected to the external terminals. As a result, balanced signals having the phase difference of 180°, which have filter characteristics, are outputted from the external terminals B and C. Therefore, the external terminal A can be used as an unbalanced input terminal, and the external terminals B and C can be used as balanced output terminals. Between the input and the output, there are provided band-pass-type filter characteristics made by the λ/2 resonator and the λ/4 resonators.

In contrast, when a balanced-type input of signals to the terminals B and C is performed, it is also possible to obtain an unbalanced-type output signal from the terminal A.

Figure 5:
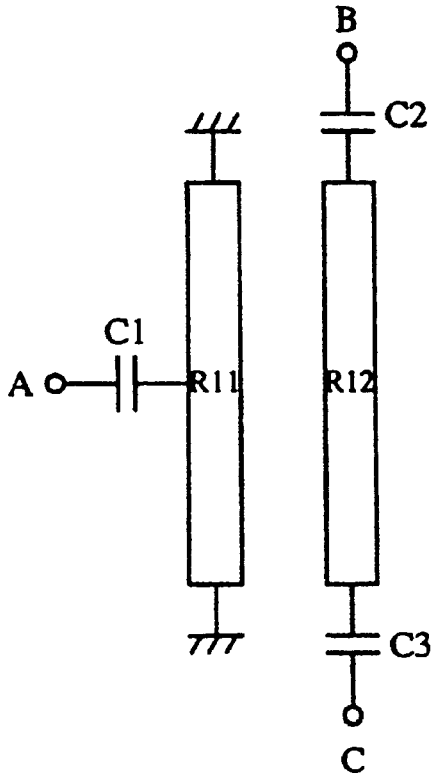
FIG. 5 shows an equivalent circuit diagram of a dielectric filter according to a fifth embodiment of the present invention.

FIG. 5 is an equivalent circuit diagram of a dielectric filter according to a fifth embodiment of the present invention. In this example, a λ/2 resonator R11 and a λ/2 resonator R12 are disposed in proximity to each other, and both ends of the resonator R11 are short-circuited. A capacitance C1 is generated between the center of the resonator R11 and a terminal A to obtain external coupling. The resonator R12, and the relationship between these resonators and the external coupling are the same as those shown in FIG. 4.

In FIG. 5, the center of the resonator R11 is equivalently an open-circuited end, and the resonator R11 and the resonator R12 make interdigital coupling. With this structure, it is possible to obtain a dielectric filter, in which the terminal A is used as an unbalanced terminal, and terminals B and C are used as balanced terminals.

Although the first to fifth embodiments use the dielectric filters formed by the micro-stripline resonators, it may also be possible to use a dielectric filter in which stripline line resonators are formed by disposing stripline electrodes at positions where dielectric layers are disposed both at the upper and lower sides of the electrodes.

Next, referring to FIGS. 6A and 6B, a description will be given of a dielectric filter formed by using a dielectric block, as a sixth embodiment of the present invention.

Figure 6A:
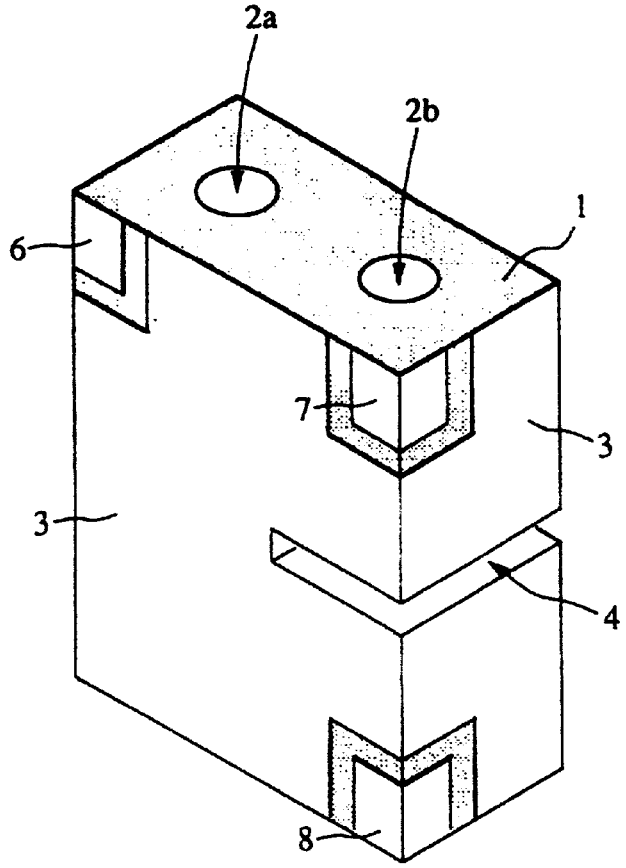
FIG. 6A and FIG. 6B respectively show a perspective view of an external appearance of a dielectric filter and a sectional view thereof according to a sixth embodiment of the present invention.
Figure 6B:
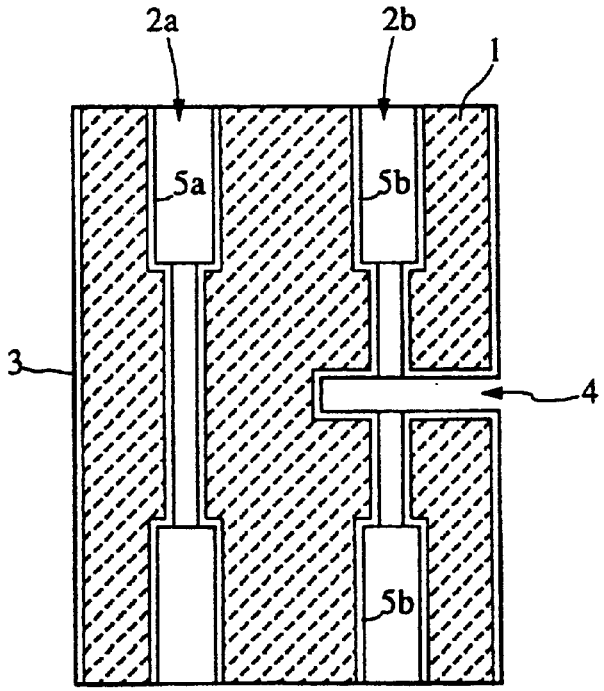

FIG. 6A is a perspective view of the external appearance of the filter, and FIG. 6B is a sectional view passing through two inner-conductor formed holes. In the direction shown in FIG. 6A, the left front surface of the filter in the figure opposes a circuit board when actually mounted on the circuit board. External terminals 6, 7, and 8 are connected to signal input/output electrodes, respectively, on the circuit board, and an outer conductor 3 is connected to the ground electrode on the circuit board.

A dielectric block 1 entirely has a substantial rectangular-parallelepiped configuration, in which two inner-conductor formed holes 2*a* and 2*b* are disposed. In addition, a slit 4 is formed in the dielectric block 1 in such a manner that the center of the inner-conductor formed hole 2*b* is cut. An outer conductor 3 is each formed on the inner surface of the slit 4, and the outer surfaces (four surfaces) except the upper and lower end faces of the dielectric block 1, which are shown in FIGS. 1A and 1B. An inner conductor 5*a* is disposed on the inner surface of the inner-conductor formed hole 2*a*, and an inner conductor 5*b* is formed on the inner surface of the inner-conductor formed hole 2*b*. In addition, on the outer surfaces of the dielectric block 1, an external terminal 6, which generates capacitance with a part near an end of the inner conductor 5*a*, and external terminals 7 and 8, which each generate capacitance with a part near each end of the inner conductor 5*b*, are formed by separating from the outer conductor 3.

With this structure, the inner conductor 5*a*, the dielectric block 1, and the outer conductor 3 serve as a single λ/2 coaxial resonator, whereas the inner conductor 5*b*, the dielectric block 1, and the outer conductor 3 serve as two λ/4 resonators. In addition, the inner diameter lengths of the inner-conductor formed holes are made different between the open-circuited end sides and the equivalently short-circuited end sides (the center parts of the inner-conductor formed holes) thereof. With this structure, coupling between adjacent resonators occurs. As a result, the dielectric filter shown in FIGS. 6A and 6B is equivalently the same as that shown in FIG. 1B. Accordingly, in the dielectric filter shown in FIGS. 6A and 6B, the external terminal 6 can be used as an unbalanced terminal, whereas the external terminals 7 and 8 are used as balanced terminals.

Although the two-stage resonators are formed in the example shown in FIGS. 6A and 6B, it is also possible to use resonators of three or more stages formed in a single dielectric block.

In addition, although the slit 4 is formed in the example shown in FIGS. 6A and 6B, as an alternative to the slit, a hole may be formed vertically to an inner-conductor formed hole, and on the inner surface of the hole, a conductor may be formed to connect the inner conductor of the inner-conductor formed hole and an external conductor 3.

Next, an example of another dielectric filter formed by using a dielectric block will be illustrated with reference to FIGS. 7A and 7B, as a seventh embodiment of the present invention.

In the example shown in FIGS. 6A and 6B, the λ/2 resonator and the two λ/4 resonators are disposed to form the dielectric filter having the unbalanced terminal and the balanced terminals. However, in the seventh embodiment, two λ/2 resonators are disposed to a dielectric filter having an unbalanced terminal and balanced terminals.

Figure 7A:
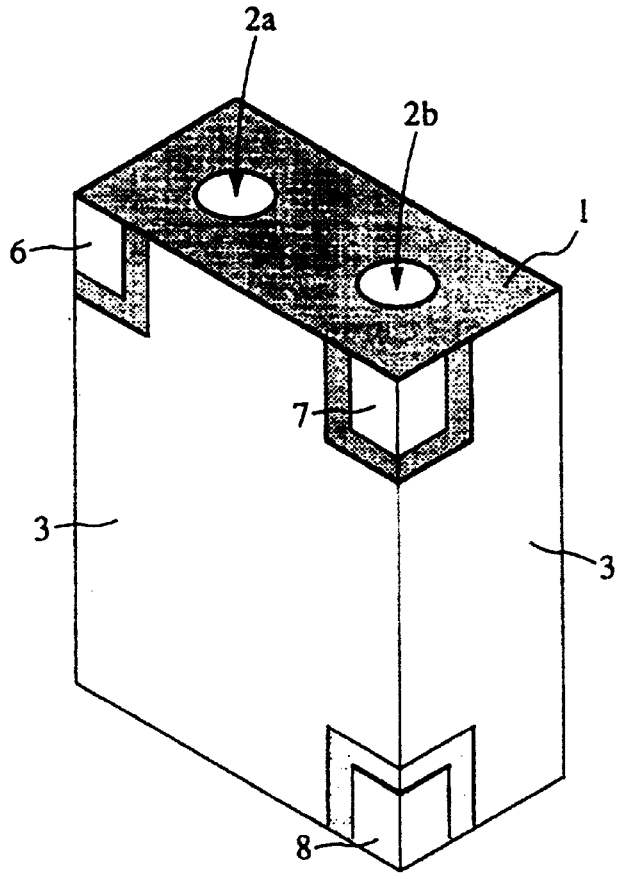
FIG. 7A and FIG. 7B respectively show a perspective view of an external appearance of a dielectric filter and a sectional view thereof according to a seventh embodiment of the present invention.
Figure 7B:
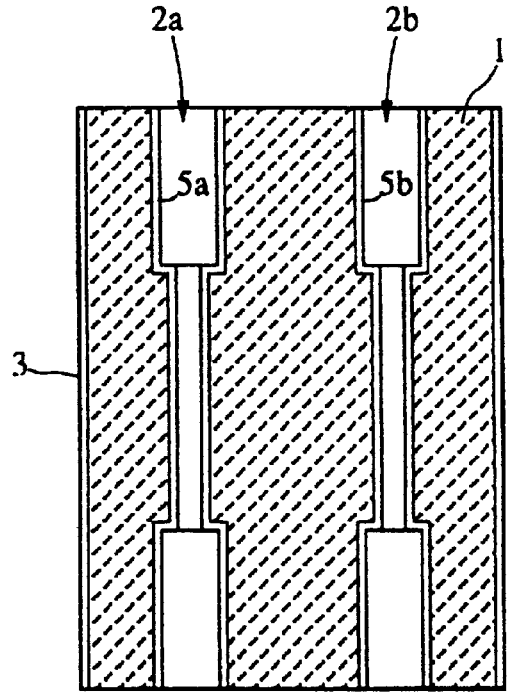

FIG. 7A is a perspective view of the external appearance of the dielectric filter, and FIG. 7B is a sectional view passing through the two inner-conductor formed holes. A dielectric block 1 entirely has a substantially rectangular-parallelepiped configuration in which two inner-conductor-formed holes 2*a* and 2*b*. Unlike the example shown in FIGS. 6A and 6B, no slit is formed in the dielectric block. An outer conductor 3 is disposed on each of the outer surfaces (four surfaces) except the upper and lower end faces of the dielectric block 1 in the figure. Inner conductors 5*a* and 5*b* are formed on the inner surfaces of the inner-conductor formed holes 2*a* and 2*b*. In addition, on the outer surfaces of the dielectric block 1, an external terminal 6 which generates capacitance with a part near an end of the inner conductor 5*a*, and external terminals 7 and 8, which each generate capacitance with parts of both ends of the inner conductor 5*b*, are formed by separating from the outer conductor 3.

With this structure, the inner conductor 5*a*, the dielectric block 1, and the outer conductor 3 serve as one λ/2 resonator, whereas the inner conductor 5*b*, the dielectric block 1, and the outer conductor 3 serve as the other λ/2 resonator. In addition, the inner diameter lengths of the inner-conductor formed holes are made different between the open-circuited end sides and the equivalently short-circuited end sides (the center parts of the inner-conductor formed holes) thereof to generate coupling between adjacent resonators. As a result, the dielectric filter shown in FIGS. 7A and 7B is equivalently the same as that shown in FIG. 4. Accordingly, the dielectric filter shown in FIGS. 7A and 7B can be used a dielectric filter having the external terminal 6 as an unbalanced terminal and the external terminals 7 and 8 as balanced terminals.

Next, referring to FIGS. 8A and 8B, the structure of a dielectric duplexer will be illustrated below.

Figure 8A:
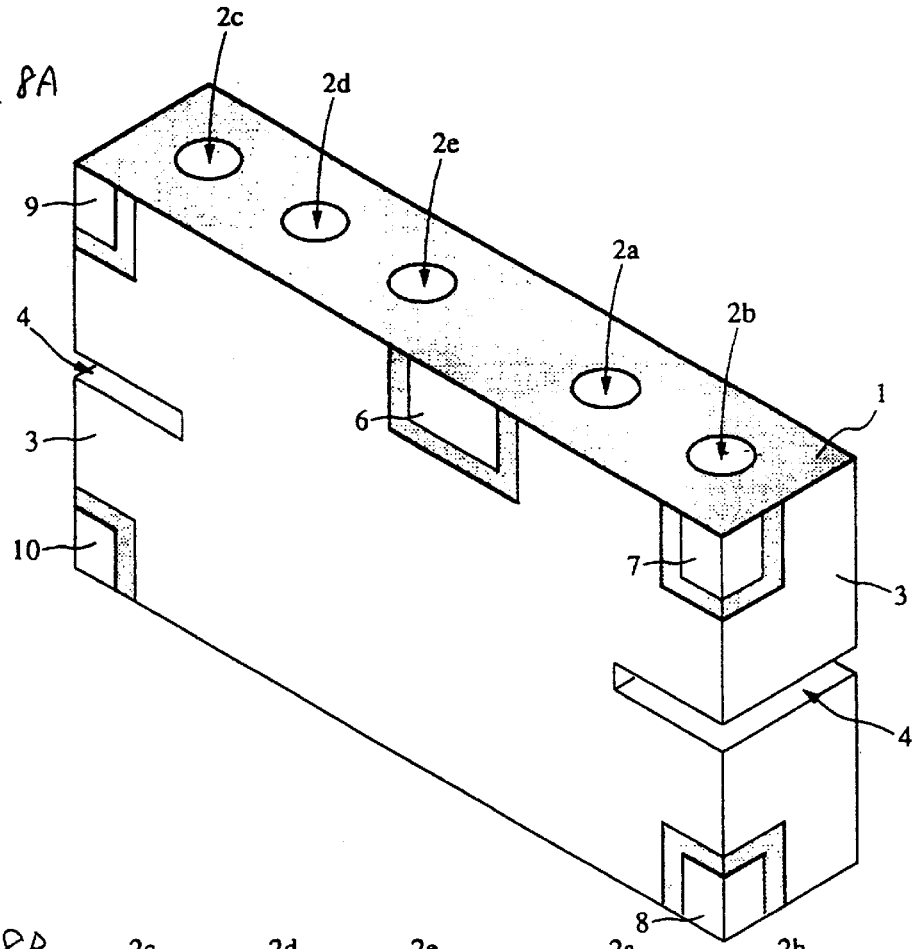
FIG. 8A and FIG. 8B respectively show a perspective view of an external appearance of a dielectric duplexer and a sectional view thereof according to an eighth embodiment of the present invention.
Figure 8B:
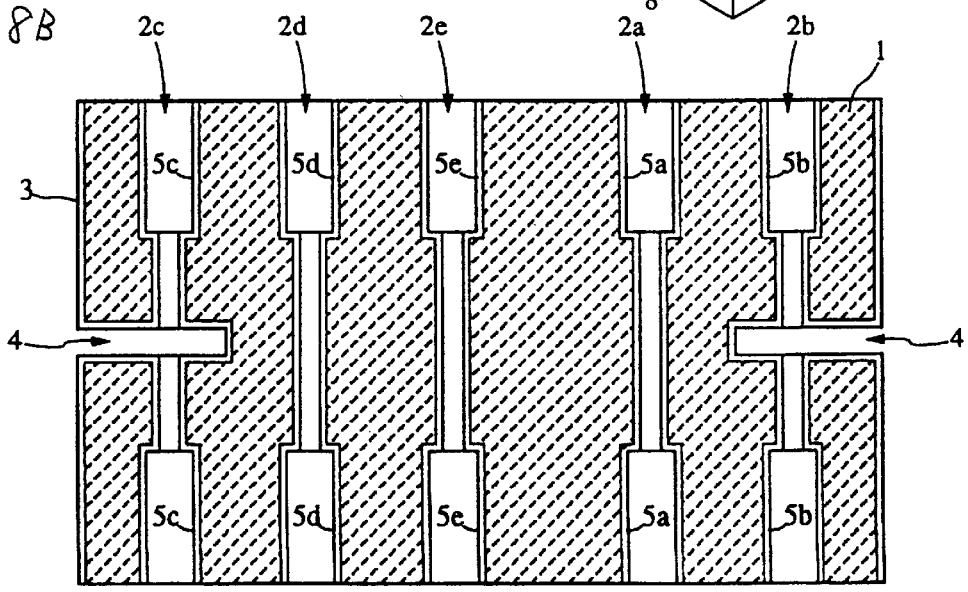

FIG. 8A is a perspective view of the external appearance of the duplexer, and FIG. 8B is a sectional view at a section passing through the inner-conductor formed hole. In the direction shown in FIG. 8A, the left-front surface of the duplexer in the figure is opposed to a circuit board when surface-mounted on the circuit board. External terminals 6, 7, 8, 9, and 10 are connected to signal input/output electrodes on the circuit board, and an outer conductor 3 is connected to a ground electrode on the circuit board.

A dielectric block 1 entirely has a roughly rectangular-parallelepiped configuration, in which five inner-conductor formed holes 2*a*, 2*b*, 2*c*, 2*d*, and 2*e* are disposed. In addition, each slit 4 is formed in the dielectric block 1 in such a manner that the centers of the inner-conductor formed holes 2*b* and 2*c* are cut. The outer conductor 3 is formed on each of the inner surfaces of the slits 4, and the outer surfaces (four surfaces) except the upper and lower end faces of the dielectric block 1 in the figure. Inner conductors 5*a* to 5*e* are each formed on the inner surfaces of the inner-conductor formed holes 2*a* to 2*e*. In addition, on the outer surfaces of the dielectric block 1 are formed an external terminal 6 which generates capacitance with a part near an end of each of the inner conductors 5*a* and 5*e*, external terminals 7 and 8 which generate capacitance with parts near the ends of the inner conductor 5*b*, and external terminals 9 and 10 which generate capacitance with parts near the ends of the inner conductor 5*c*.

With this arrangement, the inner conductors 5*a*, 5*d*, and 5*e*, the dielectric block 1, and the outer conductor 3 form $\lambda/2$ coaxial resonators, and the inner conductor 5*b*, the dielectric block 1, and the outer conductor 3 form two $\lambda/4$ resonators. In addition, the inner conductor 5*c*, the dielectric block 1, and the outer conductor 3 form two $\lambda/4$ resonators.

With this arrangement, the resonators formed by the inner conductors 5*a* and 5*b* can be used as a transmission filter, and the resonators formed by the inner conductors 5*c*, 5*d*, and 5*e* can be used as a reception filter. In this case, the external terminal 6 is used as an unbalanced antenna terminal, the external terminals 7 and 8 are used as balanced transmission-signal input terminals, and the external terminals 9 and 10 are used as balanced reception-signal output terminals.

In each of the sixth, seventh, and eighth embodiments, the coaxial resonator is formed by using the single dielectric block so as to form the dielectric filters or the dielectric duplexer. However, it may also be possible to form a dielectric filter or a dielectric duplexer comprising a coaxial resonator by bonding dielectric substrates each having a groove formed in advance therein and an inner conductor formed therein together.

In the examples shown in FIGS. 6A, 6B, 7A, 7B, 8A and 8B, each of the dielectric coaxial resonators is formed by using the end face of the dielectric block as the open-circuited end of the resonator, without forming an outer conductor thereon. However, the present invention can similarly be applied to a dielectric coaxial resonator of a type in which a coupling electrode is formed on the end face of the dielectric block, used as the open-circuited end. Furthermore, the invention can similarly be applied to a dielectric coaxial resonator of a type in which a non-inner-conductor formed portion (a part where the inner conductor of an inner-conductor formed hole is eliminated) is formed inside each inner-conductor formed hole or in proximity to the opening thereof, without disposing no open face on the outer surfaces of the dielectric block.

Next, the structure of a communication apparatus incorporating the above dielectric filters or the above dielectric duplexer will be illustrated with reference to FIG. 9.

In this figure, ANT indicates a transmission/reception antenna, DPX indicates a duplexer, BPFa, BPFb, and BPFc indicate band pass filters, AMPa and AMPb indicate amplifying circuits, MIXa and MIXb indicate mixers, OSC indicates an oscillator, and DIV indicates a frequency divider (a synthesizer). The MIXa modulates a frequency signal outputted from the DIV by a modulation signal, the BPFa passes only signals in a transmission frequency band, and the AMPa performs the power-amplification of the signals to transmit from the ANT via the DPX. The BPFb passes only signals in the reception frequency band among the signals outputted from the DPX, and the AMPb amplifies the signals. The MIXb mixes the frequency signals outputted from the BPFc with the received signals to output intermediate frequency signals IF.

Figure 9:
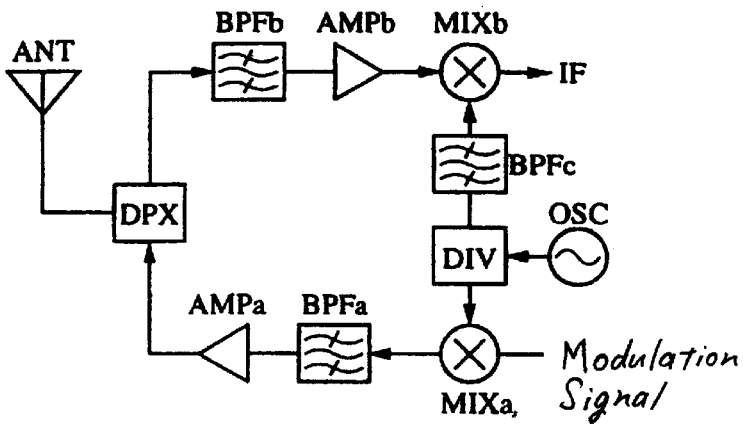
FIG. 9 shows a block diagram illustrating the structure of a communication apparatus.
Figure 10A:
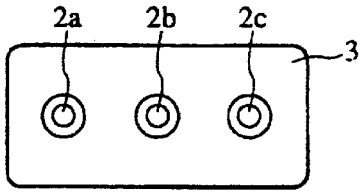
Fig. 10A (Prior Art)
FIGS. 10A, 10B, 10C, 10D and 10E show projection views illustrating a prior art dielectric filter.
Figure 10D:
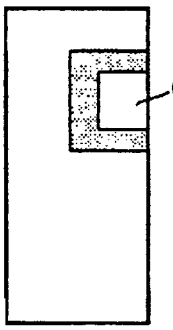
Fig. 10D (Prior Art)
Figure 10B:
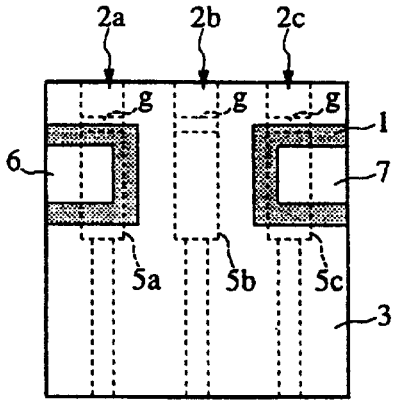
Fig. 10B (Prior Art)
Figure 10E:
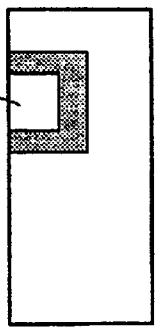
Fig. 10E (Prior Art)
Figure 10C:
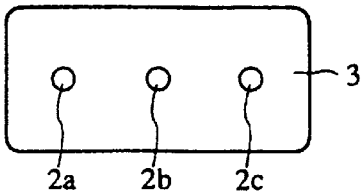
Fig. 10C (Prior Art)

As the duplexer DPX shown in FIG. 9, the duplexer having the structure shown in 8A and 8B can be used. In addition, as the band pass filters BPFa, BPFb, and BPFc, the dielectric filters having the structures shown in FIGS. 1 to 7B can be used. In this way, the overall compact communication apparatus can be formed.

While the invention has been particularly shown and described with reference to preferred embodiments thereof, it will be understood by those skilled in the art that the forgoing and other changes in form and details may be made therein without departing from the spirit of the invention.

What is claimed is:

1. A dielectric filter comprising:

a $\lambda/2$ resonator having a center and two ends, for generating resonance at a length of substantially ½-wavelength at a predetermined frequency, said $\lambda/2$ resonator having both ends connected to ground by first and second capacitances, respectively; and a pair of $\lambda/4$ resonators respectively for generating resonance at a length of substantially ¼-wavelength at a frequency substantially equal to the predetermined frequency, each $\lambda/4$ resonator having one end open-circuited and the other end short-circuited;

wherein each of the pair of $\lambda/4$ resonators is disposed between a respective one of said two ends and the vicinity of the center of the $\lambda/2$ resonator;

an unbalanced terminal is coupled by a third capacitance to the $\lambda/2$ resonator; and a balanced terminal is provided by a pair of terminals coupled to the pair of $\lambda/4$ resonators by fourth and fifth capacitances, respectively.

2. The dielectric filter according to claim 1, wherein each said resonator comprises a microstripline or a stripline.

3. A communication apparatus comprising the dielectric filter of claim 1, and further comprising a high frequency circuit including at least one of a transmission circuit and a reception circuit, said dielectric filter being connected to said high frequency circuit.

4. The dielectric filter of claim 1, wherein said pair of terminals providing said balanced terminal are disposed respectively in the vicinity of said two ends of said λ/2 resonator.

5. A dielectric filter comprising:

a λ/2 resonator having a center and two ends, for generating resonance at a length of substantially ½-wavelength at a predetermined frequency; and a pair of λ/4 resonators respectively for generating resonance at a length of substantially ¼-wavelength at a frequency substantially equal to the predetermined frequency;

wherein each of the pair of λ/4 resonators has a first end in the vicinity of a respective one of said two ends of the λ/2 resonator and a second end in the vicinity of the center of the λ/2 resonator;

an unbalanced terminal is coupled to the λ/2 resonator; and a balanced terminal is provided by a pair of terminals coupled respectively to the first ends of the λ/4 resonators, and said second ends of said λ/4 resonators are connected to ground.

6. The dielectric filter according to claim 5, wherein each said resonator comprises a microstripline or a stripline.

7. A communication apparatus comprising the dielectric filter of claim 5, and further comprising a high frequency circuit including at least one of a transmission circuit and a reception circuit, said dielectric filter being connected to said high frequency circuit.

8. The dielectric filter of claim 5, wherein said two ends of said λ/2 resonator are connected to ground.

9. A dielectric filter comprising:

a λ/2 resonator having a center and two ends, for generating resonance at a length of substantially ½-wavelength at a predetermined frequency; and a pair of λ/4 resonators respectively for generating resonance at a length of substantially ¼-wavelength at a frequency substantially equal to the predetermined frequency;

wherein each of the pair of λ/4 resonators has a first end in the vicinity of a respective one of said two ends of the λ/2 resonator and a second end in the vicinity of the center of the λ/2 resonator, an unbalanced terminal is coupled by a first capacitance to the λ/2 resonator; and a balanced terminal is provided by a pair of terminals coupled respectively to the first ends of the λ/4 resonators by second and third capacitances, and said second ends of said λ/4 resonators are connected to ground.

10. The dielectric filter according to claim 9, wherein each said resonator comprises a microstripline or a stripline.

11. A communication apparatus comprising the dielectric filter of claim 9, and further comprising a high frequency circuit including at least one of a transmission circuit and a reception circuit, said dielectric filter being connected to said high frequency circuit.

12. The dielectric filter of claim 9, wherein said two ends of said λ/2 resonator are connected to ground by respective capacitances.

13. A dielectric duplexer comprising the dielectric filter of one of claims 1, 9, and 5, and further comprising a second dielectric filter having two balanced or unbalanced terminals, wherein a respective terminal of said second dielectric filter and a corresponding terminal of said first-mentioned dielectric filter are interconnected to provide a common terminal of said duplexer.

14. A communication apparatus comprising the dielectric duplexer of claim 13, further comprising an antenna terminal connected to said common terminal of said duplexer, and a transmission circuit and a reception circuit connected respectively to corresponding ones of said terminals other than the terminals connected to said antenna terminal.

* * * * *